US010758971B2

(12) United States Patent
Blais et al.

(10) Patent No.: US 10,758,971 B2
(45) Date of Patent: Sep. 1, 2020

(54) SYSTEM AND METHOD FOR CONTROLLING THE CASTING OF A PRODUCT

(71) Applicant: CONSTELLIUM ISSOIRE, Issoire (FR)

(72) Inventors: Soizic Blais, Saint Etienne de Crossey (FR); Franck Renard, Moirans (FR); Nicolas Guichou, Chatenay (FR); Arnaud Ballu, Biviers (FR); Bernard Valentin, Voiron (FR)

(73) Assignee: CONSTELLIUM ISSOIRE, Issoire (FR)

( * ) Notice: Subject to any disclaimer, the term of this patent is extended or adjusted under 35 U.S.C. 154(b) by 113 days.

(21) Appl. No.: 16/090,641

(22) PCT Filed: Apr. 3, 2017

(86) PCT No.: PCT/FR2017/050773
§ 371 (c)(1),
(2) Date: Oct. 2, 2018

(87) PCT Pub. No.: WO2017/174914
PCT Pub. Date: Oct. 12, 2017

(65) Prior Publication Data

US 2019/0111476 A1 Apr. 18, 2019

(30) Foreign Application Priority Data

Apr. 8, 2016 (FR) ..... 16 53135

(51) Int. Cl.
*B22D 11/16* (2006.01)
*B22D 11/041* (2006.01)
(Continued)

(52) U.S. Cl.
CPC ..... *B22D 11/16* (2013.01); *B22D 11/003* (2013.01); *B22D 11/041* (2013.01); *B22D 11/148* (2013.01)

(58) Field of Classification Search
CPC ..... B22D 11/08–083; B22D 11/183; B22D 11/203
(Continued)

(56) References Cited

U.S. PATENT DOCUMENTS 3,521,696 A 7/1970 Lowman et al.
4,108,237 A * 8/1978 Brovman ..... B22D 11/08 164/425
6,279,645 B1 8/2001 McGlade et al.

FOREIGN PATENT DOCUMENTS

EP 1 155 762 A1 11/2001
GB 2 163 983 A 3/1986
JP 57032864 A * 2/1982

OTHER PUBLICATIONS

International Search Report, dated Jun. 16, 2017, corresponding to Application No. PCT/FR2017/050773.

* cited by examiner

*Primary Examiner* — Kevin E Yoon
*Assistant Examiner* — Jacky Yuen
(74) *Attorney, Agent, or Firm* — Ladas & Parry LLP; Malcolm J. MacDonald

(57) ABSTRACT

A system for controlling the progress of the manufacture of at least one product by vertical semi-continuous direct chill casting, in particular from aluminium alloy, in a fixed mold, the control system includes a dummy bottom configured to form a movable lower bottom of the fixed mold and to carry the product during casting; a weighing cell, on which the dummy bottom is arranged to rest, the weighing cell being configured to take measurements representative of the mass
(Continued)

of the product carried by the dummy bottom during casting; and a support of the dummy bottom, to which the weighing cell is linked, configured to lower the false bottom relative to the fixed mold, substantially in a vertical direction, during casting; and a processing unit connected to each weighing cell, and configured to process the measurements, and calculate the variation in the mass of the product over time.

14 Claims, 6 Drawing Sheets

(51) Int. Cl.
*B22D 11/14* (2006.01)
*B22D 11/00* (2006.01)
(58) Field of Classification Search
USPC ..... 164/445–446, 451–455
See application file for complete search history.

SYSTEM AND METHOD FOR CONTROLLING THE CASTING OF A PRODUCT

The field of the present invention relates to vertical semi-continuous casting, with direct cooling, and in particular the prevention of risks associated with the casting of a product (plate or billet) in a mold (or ingot mold).

The invention relates more particularly to a system for the continuous control of vertical semi-continuous casting, with direct cooling, in particular an aluminum alloy, for manufacturing one or more products.

Plates for rolling and extrusion billets are typically manufactured by casting in a mold, or ingot mold, vertical and positioned on a casting table above a casting pit or well.

The mold is rectangular in the case of plates or cylindrical in the case of billets, with open ends, with the exception of the bottom end closed at the start of the casting by a bottom block that moves downwards by means of a lowerator during the casting of the plate or billet, the top end being intended for the metal feed.

At the start of the casting process, the bottom block is in its highest position in the mold. The casting begins with a filling step, consisting of pouring the molten metal into a mold. During any one casting, a plurality of molds may be filled at the same time. It is important for the filling to be done homogeneously in the molds. As from a certain quantity of metal poured, the metal begins to be cooled, typically by means of water, and the bottom block is lowered at a predetermined speed. This is the lowering step. The use of a deflector during the cooling step is advantageous for preventing the appearance of slits. This makes it possible in fact to reduce the temperature gradient within the solidified metal. The deflector makes it possible to stop the flow of cooling water at a certain distance from the molten-metal dispensing point. Typically the deflector is a rubber part that surrounds the mold. The solidified metal is then extracted through the bottom part of the mold and the plate or billet is thus formed. At the end of casting, the products are extracted from the pit; this is the mold stripping step.

This type of molding in which the metal extracted from the mold is cooled directly by the impact of a cooling liquid is known by the term semi-continuous casting, typically vertical, with direct cooling.

The semi-continuous casting method may present certain difficulties that it is necessary to be able to control. Among these difficulties, mention can be made of the problems of filling, surface defects, hanging problems and piercing problems.

At the start of the casting, it is essential to be capable of detecting any filling problem and to check the level of the metal in the mold in order to be able to stop the casting in the most appropriate way, if possible automatically. In the contrary case, this would constitute a significant risk from the point of view of safety by putting liquid metal in contact with the water cooling the product.

The solutions using automatic regulation of the metal level are impossible to implement in the case of charge casting. There is only one level sensor for all the flows, in general positioned in the central channel at the inlet to the dispenser. It is therefore not possible to differentiate the flows.

When the lowerator is started, the metal level is sometimes lower than the bottom of the central channel of the dispenser. The level sensor cannot therefore carry out any measurement.

The solutions based on the visual detection of metal level in each of the flows are tricky to implement since they require processing of the image recorded on each flow. The solutions based on the detection of the metal level by a sensor of the thermocouple type are ill suited to industrial implementation. Since the sensor has to react very quickly when it detects the liquid metal, it cannot be sheathed. It must therefore be changed before each new start since it is rapidly damaged by the liquid metal.

Once the casting has commenced and the filling takes place correctly, during the casting process, the external layer of the product solidifies and surrounds a part of the liquid metal not yet solidified. This non-solidified liquid metal part, also referred to as "sump" can extend over a long distance above the bottom of the mold. If the external layer of the solidified metal tears or is pierced, the liquid metal may flow through the breach. This is what is referred to as the phenomenon of metal piercing. The metal piercing phenomenon is a potentially dangerous phenomenon that may lead to risks of explosion, in particular with aluminum and the alloys thereof.

There exist a certain number of solutions for detecting piercing phenomena. Mention can be made of the U.S. Pat. No. 6,279,645 using a radiation-sensitive detector, positioned in the cooling zone: in the presence of molten metal, the infrared sensor detects temperature changes. The patent EP 1155762 proposes a system for stopping the flow of metal if a piercing phenomenon is detected. The stoppage takes place if a sacrificial element is destroyed.

It is however advantageous to act upstream of the piercing phenomenon and to detect phenomena that may give rise to it, in particular hanging phenomena, or surface defects.

The hanging phenomenon relates to the hanging of the product, which remains momentarily attached in the ingot mold and does not follow the movement of the lowerator on which the product bears during cooling thereof. Thus the product is no longer resting on its support, commonly referred to as a bottom block, and a greater and great distance is created between the bottom block, connected to the movement of the lowerator, and the sole of the product remains attached.

However, the occurrence of hanging constitutes a significant risk from the point of view of safety. This incident is in fact liable to degenerate into piercing, with discharge of liquid metal in the casting pit, either because the base of the product, since it is no longer cooled in the absence of contact with the bottom block, ends up by remelting, releasing liquid metal; or since abrupt detachment of the solidified product tears the cortical zone and releases liquid metal. The risk is even higher in the case of charge casting: because of the high metallostatic height, a piercing is liable to release a large quantity of metal.

It is therefore very important be capable of detecting hanging as soon as possible, so as to be able to manage it in the most appropriate fashion.

According to the prior art, the detection of hanging during plate casting with regulation of the metal level is based on monitoring the opening of the actuator: an actuator that remains closed for too long is an indication of hanging. However, this indication is sometimes ambiguous. Moreover, for all the other casting technologies (regulation of the level by nozzle/float or charge casting), it is not possible to use this type of detection. There is therefore a very great interest in developing an alternative system for detecting hangings.

It is also important to limit the risks of hanging upstream, by working in particular on the factors that are precursors of hanging. Observations have shown that the hanging of the cast product in an ingot mold occurs mainly during the start phase of the casting. The most frequent causes of this incident are ill-suited starting parameters, such as poor management of the camber in the case of a cast plate, or a defect in installation of the tooling, such as a defect in perpendicularity of the bottom block with respect to the ingot mold.

Finally, the solutions based on the visual detection of surface defects are tricky to implement: they require the installation of cameras in the particular atmosphere of the casting pit; the cameras must in particular be protected from moisture and any splashing of liquid metal. It is also necessary to provide a processing of the images recorded on each of the flows. This processing is made complicated by the presence of the cooling water on the surface of the products. It is moreover difficult to develop criteria making it possible to trigger the stoppage of the casting before defects degenerate into piercing. It is also important to detect very early indications of severe prolonged degradation of the surface state of the products since these defects are also liable to degenerate into piercing. When these defects persist with a certain level of gravity, it may then be advantageous to trigger a stoppage of the casting.

Thus the present invention aims to make casting safe through the control and detection of signs that are precursors of hanging, a filling defect and/or a surface defect and to stop the casting when the risks calling into question safety are high.

It is also important to be able to check the casting conditions concerning the centering of the bottom block and of the deflector with respect to the mold. This is because faulty positioning in one of these elements may lead to breakages of equipment, to premature wear of these elements or to casting difficulties of the hanging type or surface defect of the product. For example, faulty centering of the deflector with respect to the mold tends, during the descent of the bottom block and of the product, for these to interact with the deflector, which may then lead to damage to the deflector, or to jamming of the bottom block or to damage to the surface state of the product or to hanging thereof. Faulty centering of the bottom block for its part may lead to jamming thereof in the mold and consequently lead to hanging.

The present invention also aims to reveal defects in centering of the bottom block and/or of the deflector and thus to allow preventive maintenance in order to recenter these elements or to stop casting when the risks of hanging are too high.

To this end, the present invention proposes a system for controlling the carrying out of the manufacture of at least one product by vertical semi-continuous casting, with direct cooling, in particular aluminum alloy, in a fixed respective mold. Each product having a fixed mold. The control system comprises:

- at least one bottom block for each respective mold configured to form a movable bottom base of the fixed respective mold and to carry the product, during casting,
- at least one weighing cell on which the respective bottom block is disposed in abutment. The weighing cell is configured to take measurements representing the mass of the product carried by the respective bottom block during casting, and
- a bottom block support, to which the weighing cell is connected, configured to lower the/each bottom block with respect to the fixed respective mold, substantially in a vertical direction, during casting,
- at least one processing unit connected to the/each weighing cell and configured to process the measurements, to calculate the variation in mass of the product over the course of time.

The present invention also relates to a method for controlling the manufacture of at least product by vertical semi-continuous casting with direct cooling, in particular an aluminum alloy, by a control system of the invention wherein

- Casting is carried out in the respective mold so that the product is carried by the respective bottom block.
- During the casting, measurements are taken representing the mass of the product carried by the respective bottom block by means of the control system.
- The measurements are processed, during the casting, calculating the variation in mass of the products over the course of time by means of the control system.
- The casting is stopped if an abnormality in filling or surface defects and/or hanging is detected.
- If no abnormality is detected, the casting is continued until the required quantity of product is reached and stripping from the mold is carried out.

The manufacture of said product by vertical semi-continuous casting with direct cooling comprises a step of filling, descent and mold stripping.

Advantageously, the bottom block support comprises a support plate extending in a horizontal direction and configured to support the weighing cell. This configuration enables the bottom block to be supported on a horizontal surface so as to guarantee perfectly vertical casting. Preferably, the bottom block support comprises at least one holding member, substantially vertical, connected to the support plate. The holding member serves to connect the bottom block support and the weighing cell. In a mode preferred for the casting of billets, the holding member is positioned at the central part of the support plate.

Advantageously, the weighing cell is connected to the bottom block support by means of the member holding the support plate. The weighing cell comprises at least one balance, preferably two, three or four balances disposed regularly around an axis parallel to the vertical direction. This arrangement of the balances affords a reliable and reproducible recording of mass. Preferably, the balances are disposed regularly around a vertical axis, for example for a configuration of three balances they are disposed so as to define in pairs of angles of approximately 120°, so as to form an isostatic weighing cell.

Advantageously, the device comprises a protective cover serving to protect the weighing cell. The lateral walls of the protective cover protect the balances from any splashing during casting. This splashing may be liquid metal or water. The protective cover also provides thermal protection. In one possible configuration of the invention, the top part of the protective cover bears on the balance or balances; the weighing cell being housed in the protective cover.

According to an advantageous configuration of the invention, the weighing cell comprises at least one member extending in a substantially vertical direction. The member serves to position the bottom block with respect to the weighing cell in a substantially vertical direction. The member may also make it possible to position the protective cover with respect to the weighing cell in a substantially vertical direction. Advantageously, the member is a sheath, able to cover the holding member provided on the support plate.

Preferably, the bottom block comprises at least one housing. The housing cooperates with an end region of the member of the weighing cell and/or with the member holding the support plate in order to guarantee the positioning of the bottom block with respect to the weighing cell on a substantially vertical axis. The weighing cell being connected to the bottom block support, this also guarantees that the bottom block is properly positioned in order to provide vertical casting. The bottom block is thus held on a substantially vertical axis, corresponding substantially to the vertical casting axis by means of the housing that receives an end region of the member of the weighing cell, connected to the bottom block support. In this configuration, the bottom block is free to rotate about the axis of the member.

In order to prevent escape of the bottom block, in particular during the mold-stripping step, in the vertical direction, the bottom block is advantageously provided with at least one vertical holding means. The vertical holding means must not statically connect the bottom block to the weighing cell during the filling and descent step during casting. This vertical holding means is for example configured to be engaged in a groove provided on the end region of the member of the weighing cell.

Advantageously, the end region of the member of the weighing cell has a height less than the depth of the sheath housing of the bottom block.

Thus, in an advantageous configuration of the invention, the weighing cell connected to the bottom block support of the control system comprises at least one sheath extending in a vertical direction. The sheath is intended to cover the holding member provided on the support plate of the bottom block support. The end region of the sheath is configured to cooperate with the sheath housing of the bottom block so as to engage on and hold the bottom block in a substantially vertical direction.

In a configuration of the invention that is particularly advantageous for the casting of billets, the member of the weighing cell, the holding member provided on support plate of the bottom block support and the sheath housing of the bottom block are situated in a central position of the control system.

The method of the invention applies to products in the form of both plates and billets.

In one embodiment of the method, an interface makes it possible to display the variation in mass of the products over the course of time for each weighing cell. This can indicate and/or alert with regard to filling problems and/or surface defects and/or hanging problems according to changes in mass of the products measured over the course of time.

Preferably, in the case where more than one balance is integrated in the weighing cell, the processing unit calculates the average of the mass values measured by all these balances relating to each product. This average is considered to correspond to the mass of the product.

In another embodiment of the method, the interface may be replaced by an automatic controller or connected to an automatic controller.

The automatic controller may automatically interrupt the casting when the variation in mass of at least one product over the course of time is symptomatic of a filling problem, that is to say, once a period $t_c$ has elapsed after the start of the casting, when the mass of at least one product, that is to say the average of the mass values measured by all the balances relating to each product, is less than or equal to a threshold mass value Ms.

The automatic controller may also interrupt casting when the variation in mass of a product over the course of time is symptomatic of a hanging problem or surface defects, on the basis of criteria combining the amplitude and duration of these variations in mass. These predetermined conditions comprise a variation in mass determined over a given period of time.

The casting is interrupted by stopping the liquid-metal feed, in particular liquid aluminum alloy, in the spout providing the metal alloy in at least one flow provided on the bottom block support. The movement of the bottom block may also be interrupted by stopping the lowerator. Once secured, the casting device is made accessible to the operators, who can work on site in order to deal with the problem identified.

Thus the present invention relates to both a method and a device making it possible to control and protect the carrying out of multi-flow vertical casting of plates or billets. It is based on the continuous monitoring of the solidification of the product by means of balances installed on each of the bottom blocks, allowing:

- monitoring of the filling of each flow
- monitoring of the states of each of the products during casting
- detection of hanging.

Other aspects, aims and advantages of the present invention will appear more clearly from a reading of the following description of an embodiment thereof, given by way of non-limitative example and made with reference to the accompanying drawings. The figures are not necessarily to the scale of all the elements shown so as to improve legibility thereof. In the remainder of the description, for reasons of simplification, identical, similar or equivalent elements of the various embodiments bear the same numerical references.

Figure 1:
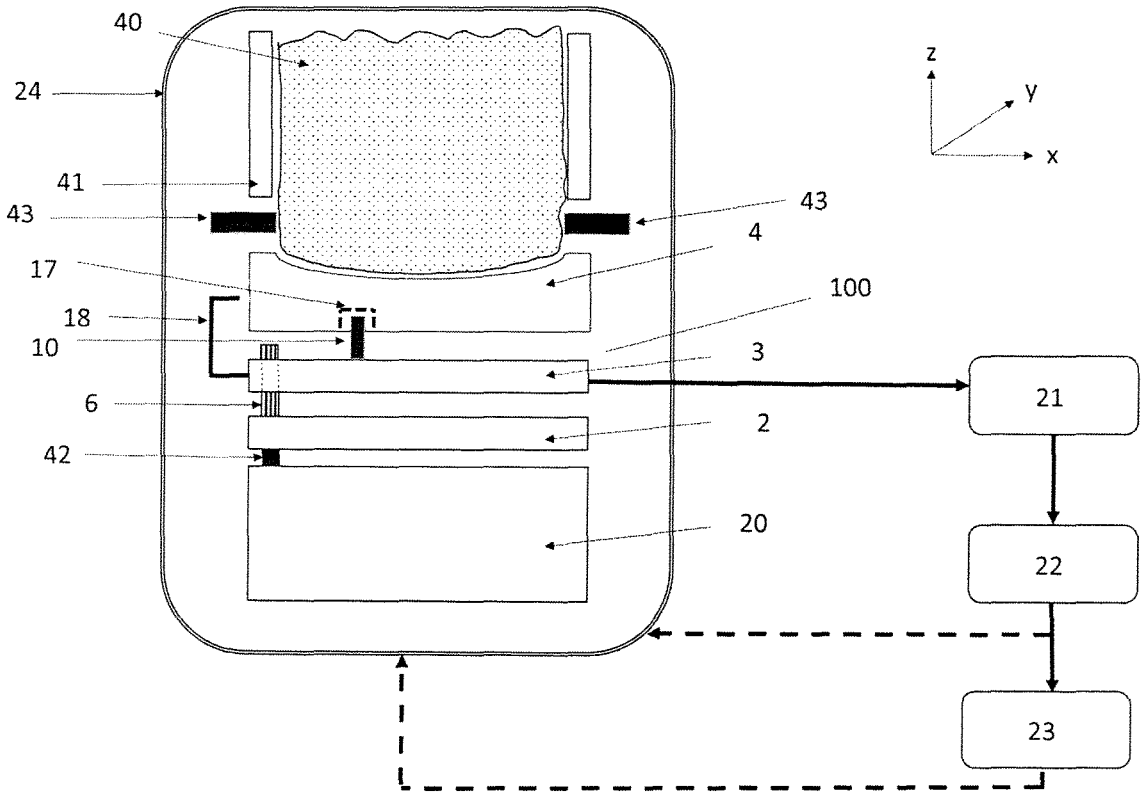
FIG. 1 is a block diagram of implementation of the control system.
Figure 2:
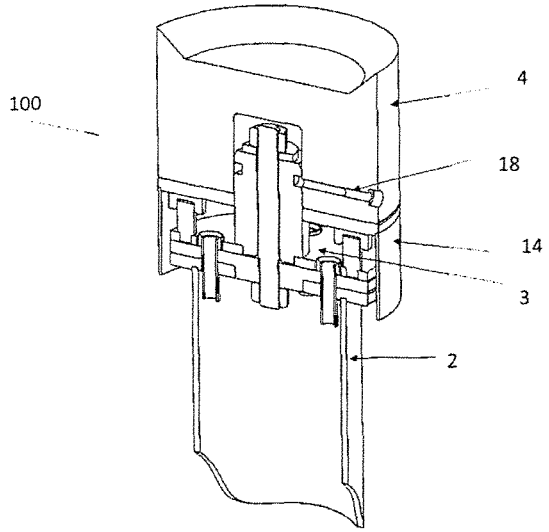
FIG. 2 illustrates the system for controlling a flow, consisting of a bottom block secured to the bottom block support according to one embodiment of the invention.

FIG. 1 is a block diagram of an embodiment of the control system 100. The control system 100 is integrated in a vertical semi-continuous casting machine with direct cooling 24. It comprises a bottom block 4 on which there rests a cast product 40 and a fixed mold 41 and a deflector 43. The bottom block 4 constitutes, at the time of the start of the casting, during the filling step, the bottom of the fixed mold 41. The bottom block comes into abutment on a weighing cell 3 that is connected to the bottom block support 2 by means of a holding member 6. The bottom block support 2 is secured to a lowerator 20 by means of a connection member 42. A vertical holding means 18 makes it possible to hold the bottom block 4 on the weighing cell during the mold-stripping operation, which takes place at the end of casting. The weighing cell 3 comprises a member 10 allowing the positioning of the bottom block with respect to the weighing cell and optionally that of the protective cover (not shown). The member 10 can cover the holding member 6. The bottom block 4 is held on the substantially vertical axis by means of a housing 17, the housing receiving an end region of the member 10 of the weighing cell 3. The weighing cell is connected to a processing unit 21 configured to process the measurements, to calculate the variations in mass of the cast product 40 during casting for each balance integrated in the weighing cell. The number of balances may be equal to 1, 2, 3 or 4. The mass measured by each of the balances is transferred continuously to the processing unit 21, which makes it possible to know in real time the change in mass as a function of time or the duration of the casting. In particular, the measured mass of each product (plate or billet) is calculated continuously by taking the average of the measurements of each of the balances. The processing unit 21 can be connected to an interface 22 for continuously displaying the change in the mass of the products. This interface 22 may be common to a plurality of flows. The operator, according to the trends of the curves displayed, may decide to interrupt the casting. This is because, according to the change in the mass of the products, it is possible to know whether a filling problem (FIG. 9) or a hanging (FIG. 7) is occurring, or if the product will exhibit a surface defect (FIG. 8). The processing unit 21 can also be connected to an automatic controller 23. The different processing algorithms are then used by the automatic controller 23 to monitor the various abnormalities that may arise, such as a defect in filling of the mold, a surface defect of the products in continuous operation and hangings. This automatic controller 23 makes it possible to interrupt the casting automatically.

FIGS. 2 to 6 show perspective views of a control system 100 intended for the casting of billets. The control system 100 is shown in cross-section. It comprises a bottom block support 2 to which a weighing cell 3 is connected, on which a bottom block 4 comes into abutment. The bottom block support 2 is secured to a lowerator (not illustrated) that drives it in a vertical descending movement during casting. The bottom block 4 is in abutment on the weighing cell 3, which is connected to the bottom block support 2 so as to follow the movement thereof and to constitute a movable bottom base of a fixed mold (not illustrated). This device is provided for each of the flows. In an embodiment that is not shown, the bottom block support 2 may be common to a plurality of flows. Thus a liquid metal is poured by a spout into each of the molds, which confers on the metal in the course of cooling the required product form, here a billet. The metal in the course of solidification is then carried by the bottom block 4, which is lowered so as to allow filling of the mold and to reach the final length of the required billet. The manufactured products take varied forms, such as billets or plates in particular.

As illustrated in FIG. 1, each of the balances 9 of the weighing cells 3 is connected to a processing unit configured to process the measurements, to calculate the variations in mass during casting. This processing unit may be connected to an interface and/or an automatic controller. The interface makes it possible to continuously display the variations in mass and to interrupt casting when significant abnormalities are detected. The automatic controller makes it possible to do this automatically.

Figure 3:
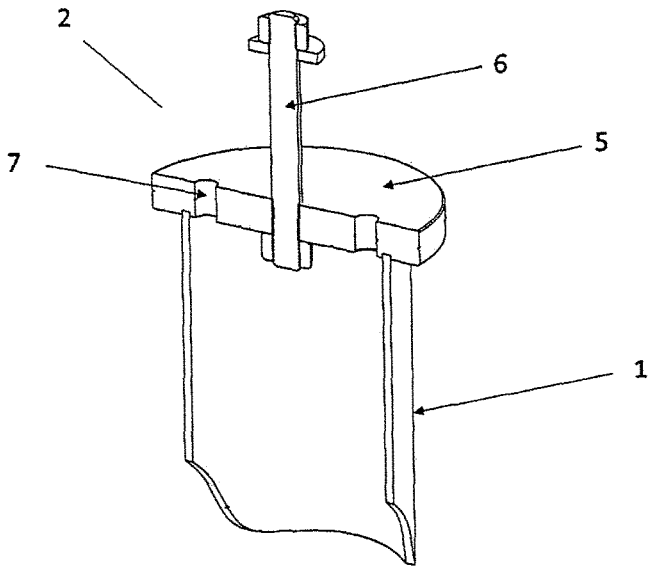
FIG. 3 illustrates the bottom block support according to one embodiment of the invention.

FIG. 3 shows a perspective view of the bottom block support 2. The bottom block support 2 is shown in cross-section. It comprises a plate 5 supporting the bottom block support extending in a horizontal direction and serving as a support for accommodating the weighing cells 3 (not shown in FIG. 3) and a casing 1 bearing under the support plate 5. The support plate 5 comprises a central holding member 6 having a direction parallel to the vertical direction. The purpose of this holding member 6 is to connect the support plate to the weighing cell, and to provide the positioning and holding thereof. This support plate 5 has passage orifices 7 enabling elements to pass, typically cables (not shown) connected to the weighing cell. These orifices 7 collaborate with the cable bushings 12 of the weighing cell shown in FIG. 4.

Figure 4:
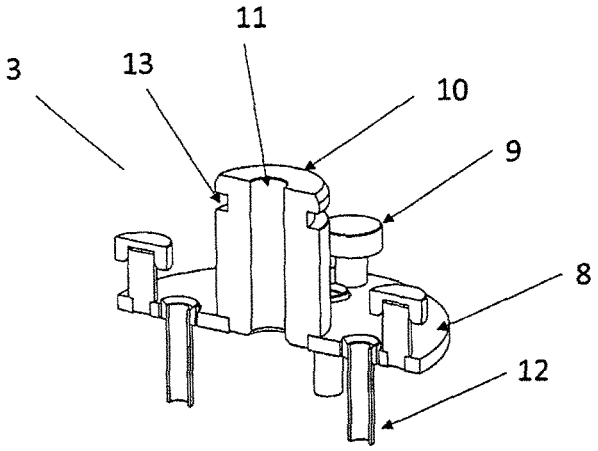
FIG. 4 illustrates the weighing cell according to one embodiment of the invention.

FIG. 4 shows a perspective view of the weighing cell 3. The weighing cell 3 is shown in cross-section. It comprises a horizontal support plate 8 for the weighing cell on which four balances 9 are disposed, disposed regularly around a vertical axis, this axis being that of the member 10. The member 10 is a central sheath. In an embodiment that is not shown, the number of balances may be equal to 1, 2 or 3. The holding member 6 for the support plate 5 collaborates with the central sheath 10, via a central orifice 11 of the weighing cell. The end region of the central sheath 10 comprises a groove 13 extending over the outer circumference of the central sheath 10, intended to cooperate with vertical holding means such as screws 18 of the bottom block. The weighing cell has cable bushings 12; preferably and non-limitatively, there are as many cable bushings as there are balances.

Figure 5:
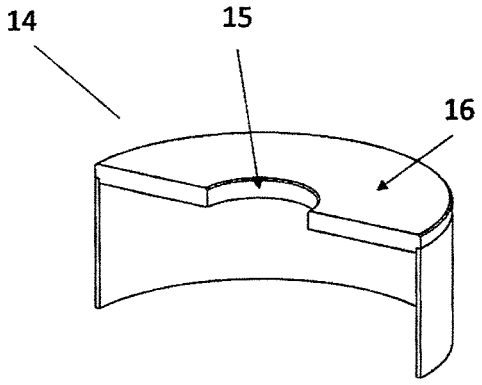
FIG. 5 illustrates the protective cover of the weighing cell according to one embodiment of the invention.

FIG. 5 shows a perspective view of the protective cover 14. The protective cover 14 is shown in cross-section. The top disc 16 of the protective cover 14 comprises an orifice 15 configured to allow engagement around the central sheath 10 so as to hold the cover on a substantially vertical axis. The weight of the cover is uniformly distributed over the four balances 9. The holding member 6 for the support plate 5 cooperates with the protective cover via a central orifice 15 of the protective cover 14.

Figure 6:
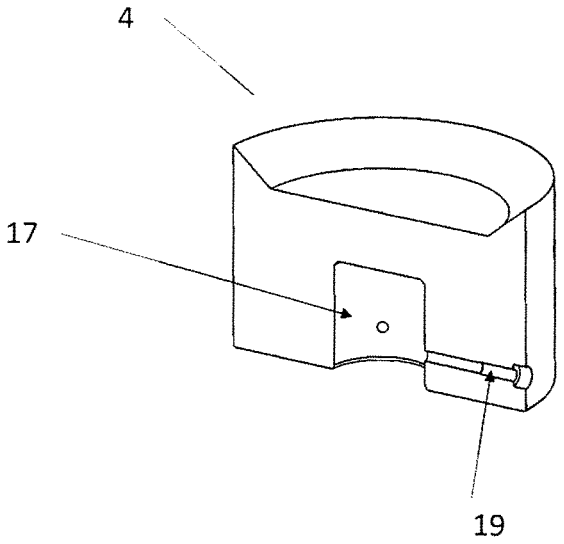
FIG. 6 illustrates the bottom block according to one embodiment of the invention.

FIG. 6 shows a perspective view of the bottom block 4. The bottom block 4 is shown in cross-section. It comprises a central housing 17 that receives the end region of the central sheath 10 that has a height less than the depth of said housing 17. The bottom block 4 comprises a bore 19 passing radially through the bottom block 4 until it emerges in the housing 17. The bore 19 is threaded (not shown). The vertical holding means used is a screw 18 (not shown in FIG. 6), conformed so as to cooperate with the bore 19. The screw 18 has a length such that, once it is screwed into the bore 19, it can engage in the groove 13 of the central sheath 10 of the weighing cell. The height of the groove 13 of the sheath 10 is greater than the diameter of the screw 18. This configuration thus makes it possible to hold the bottom block 4 on the weighing cell 3 during the step of removing from the mold. The distance separating the internal face of the groove of the sheath from the contact of the screw collaborating therewith is greater than the travel of the screw. This is necessary for the correct functioning of the weighing cell, so as not to disturb or interfere with the measurement of the balance or balances. The vertical holding means makes it possible to prevent any escape of the bottom block (4) from its support when the product of the casting, at the end thereof, is extracted by lifting, at the time of the phase of removing the product from the mold.

FIGS. 7 to 11 illustrate various abnormalities detected by the control system 100 according to the present invention. The X axis shows the time elapsed and the Y axis shows the measured mass. These curves are examples of representations that can be displayed by the interface 22. FIGS. 7 to 11 illustrate weighing curves for vertical semi-continuous castings, with direct cooling, for manufacturing billets.

Figure 7:
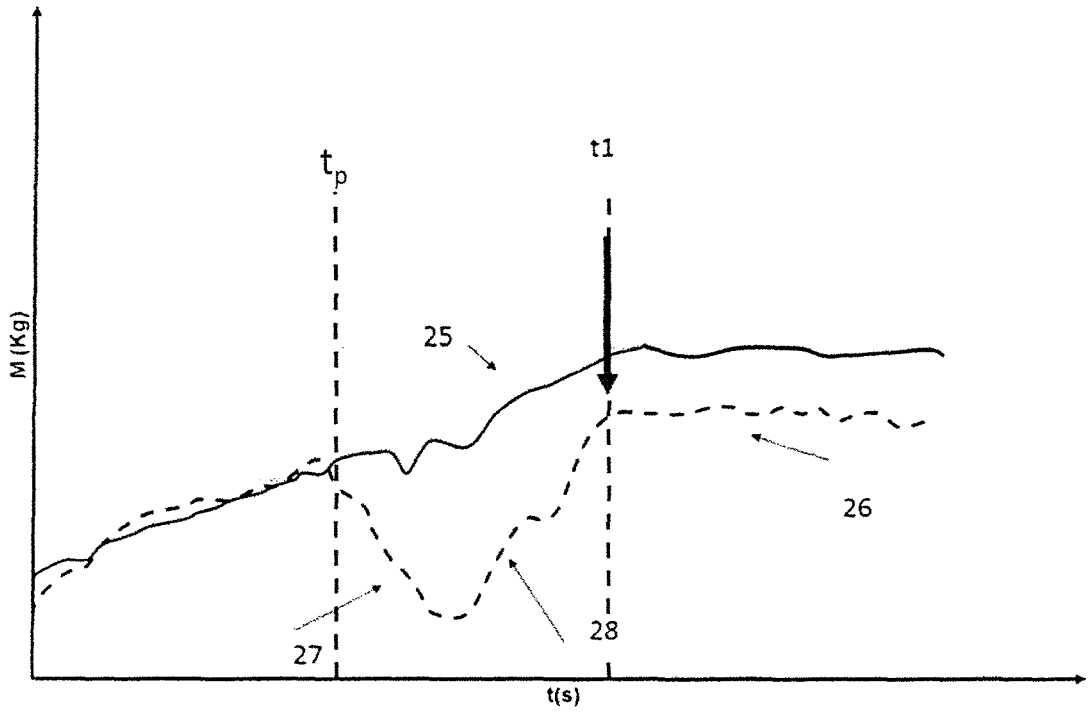
FIG. 7 illustrates two product mass change curves as a function of time, showing a normal change and a change symptomatic of a hanging problem.
Figure 8:
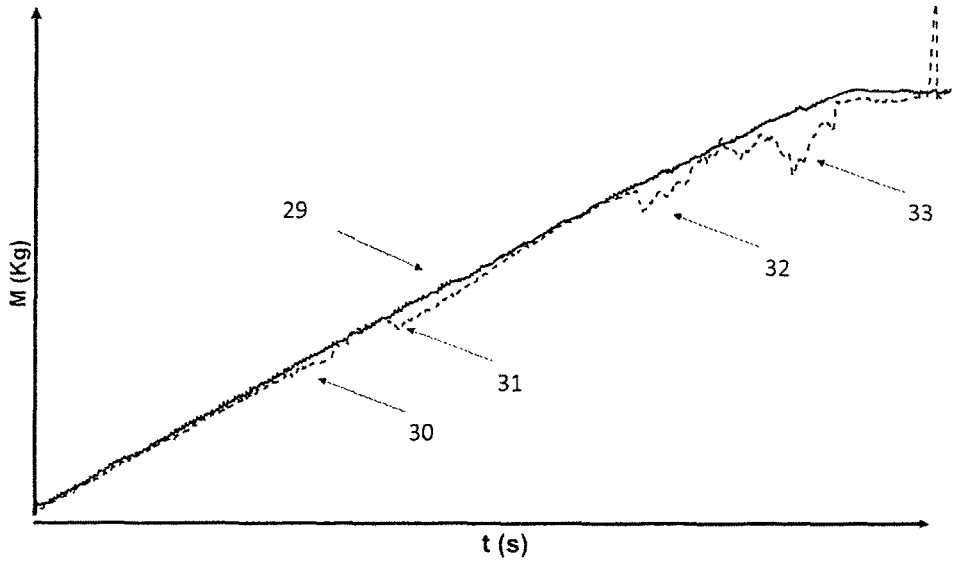
FIG. 8 illustrates two product mass change curves as a function of time showing normal change and change symptomatic of surface defects.

FIG. 7 shows two curves for the change in mass of a product as a function of time or duration of casting. Each of the curves corresponds to a different flow occurring during the same casting. The curve in a solid line 25 corresponds to the normal change in the mass of a product. The mass increases during the casting period. It exhibits no abnormal break in slope until the time t1: the casting takes place normally, without any filling problem, without sticking or hanging of the product. The curve in a broken line 26 shows a change in mass of the product for which a hanging phenomenon has occurred as from the time tp. The curve 26 exhibits a significant break 27 in the slope illustrating a start of hanging. This is because the significant reduction in mass, typically greater than approximately 50% of the normal mass, preferentially 60%, during a very short period of time, particularly for a period of approximately 30 s, preferentially approximately 20 seconds, testifies to a hanging phenomenon. This is because, in the case of hanging, the product no longer rests on the bottom block 4, which results in an abrupt lightening and therefore an abrupt break in slope on the weighing curve. After the abrupt drop in mass, it is noted that the mass changes once again 28 showing that a product has once again been in contact with the bottom block. However, beyond time t1, the mass no longer changes on the curve in a broken line 26. This corresponds to a stoppage of pouring at the end of time t1. The curve 25 also no longer changes as from time t1 since, in the case of the manufacture of billets with multiflows, the interruption in the supply of metal interrupts the process of solidification of all the flows even if only one exhibits a hanging problem.

FIG. 8 shows two curves for change in the mass of a product as a function of time or duration of casting. Each of the curves corresponds to a different flow occurring during the same casting. The curve in a solid line 29 corresponds to the normal change in the mass of a product. The mass increases during the casting period. It exhibits no abnormal break in slope: the casting takes place normally, without any filling problem, without sticking or hanging of the product. The curve in a broken line 30 shows a change in mass of product for which problems of surface defects are observed. The curve in a broken line 30 has dips 31, 32, 33. These dips are typical of isolated sticking of metal on the mold causing surface defects. This is because each surface defect results in a change in the friction of the product on the walls of the mold and therefore a local variation in the setting curve of the product. The signal processing algorithm implemented on the automatic controller consists of detecting the appearance of variations with respect to the ideal setting curve and triggering automatically a stoppage in the casting on the basis of criteria combining the amplitude and duration of these variations. The ideal setting curve being related to the density of the cast product, the speed of casting, the format of the cast product. On the basis of criteria combining amplitude and duration of lightening, the automatic control is then capable of distinguishing a simple sticking of the product, without any consequence for the remainder of the casting, real hanging or marked surface defects liable to degenerate into piercing.

The setting curves also make it possible to monitor the filling of the casting: in this case, the signal processing algorithm consists of checking that, once the time tc has elapsed after the start of the casting, the average mass value calculated from the measurements made by the balances 9 for each weighing cell is greater than or equal to a threshold mass value Ms. In the contrary case, if at least one of the mass values is less than the threshold value Ms, the automatic controller automatically triggers a stoppage of casting, under optimum safety conditions for the personnel. The values of tc and Ms depend on the product cast and the casting conditions; they depend in particular on the format of the cast product, the diameter of the billet or the dimension of the plate in particular, the density of the product and the speed of casting. These values are sized so that, in the event of a filling defect in at least one flow, there is no risk of water/liquid metal contact when the lowerator starts.

Figure 9:
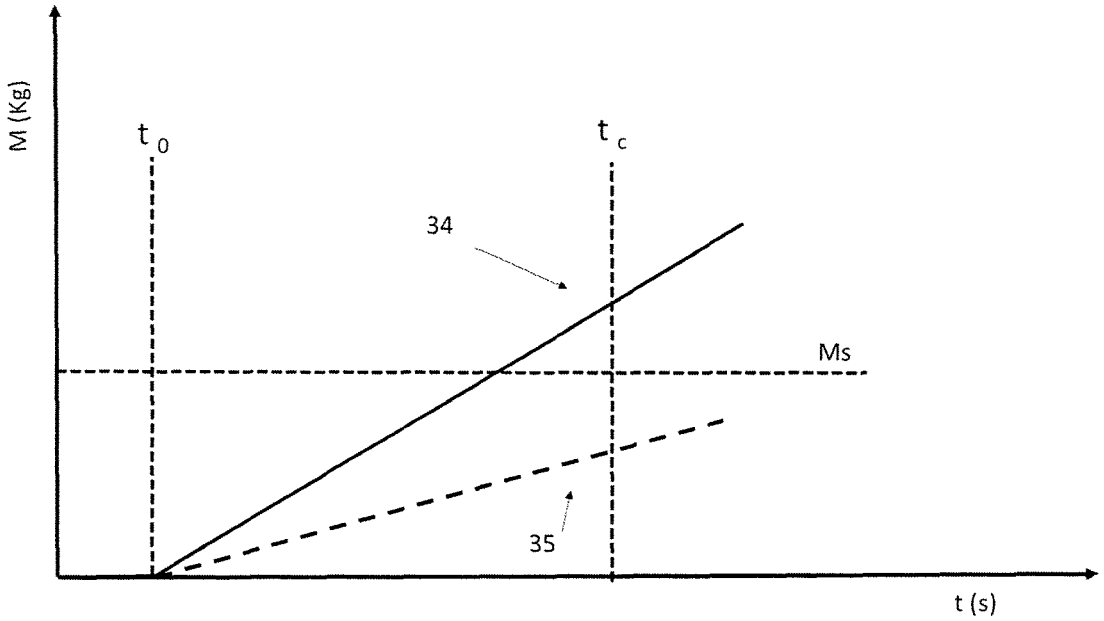
FIG. 9 illustrates schematically two product mass change curves as a function of time showing normal change and change symptomatic of a filling defect.

FIG. 9 illustrates the trend of the product mass change curves as a function of time measured by a balance 9. The curve in a solid line 34 corresponds to normal casting. The filling begins as from time t0, the mass increases regularly. At the end of a time tc corresponding to the duration of control of filling appropriate to the casting configuration, the mass measured by the balance 9 is greater than the threshold mass Ms defined for the casting configuration. There is no filling problem. The curve in a broken line 35 has a trend similar to the curve 34 but, at the end of the time tc, the mass measured by the balance 9 is less than the threshold mass Ms. There is a filling problem. It is then desirable to stop the casting, which is done a short time after, typically after a few seconds, preferentially 1 second.

Figure 10:
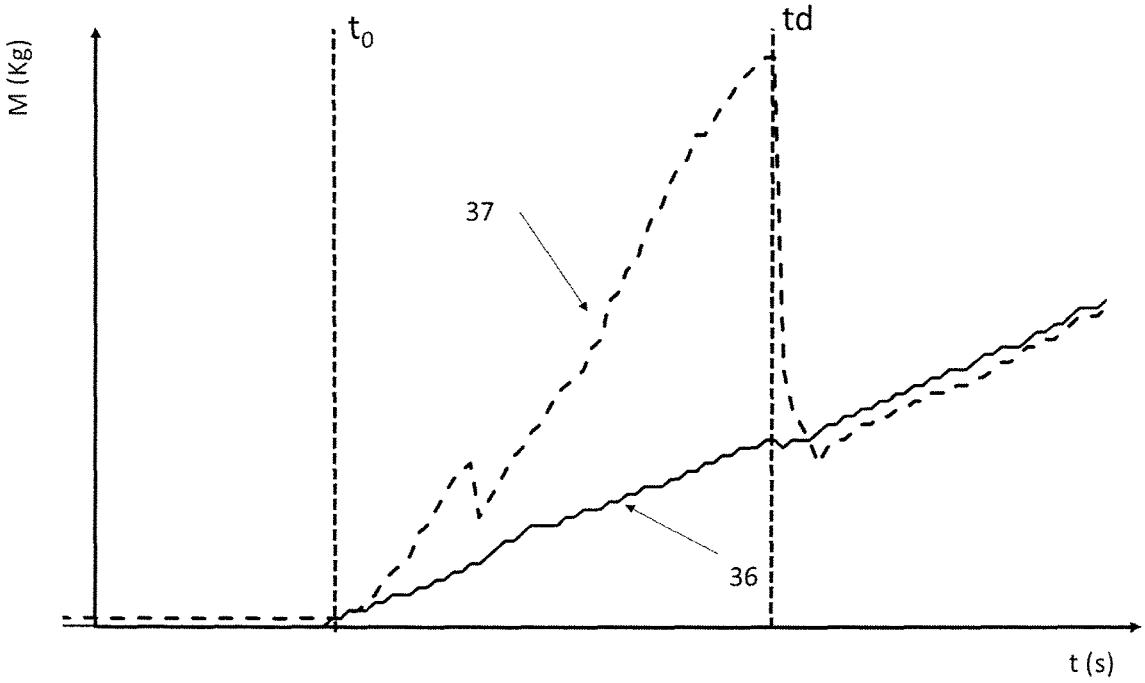
FIG. 10 illustrates schematically two product mass change curves as a function of time showing normal change and change symptomatic of faulty centering of the bottom block.

FIG. 10 shows two curves for the change of mass of a product as a function of time or duration of casting. Each of the curves corresponds to a different flow occurring during the same casting. The curve in a solid line 36 corresponds to the normal change in the mass of a product. As from time $t_0$, corresponding to the start of filling, the mass increases according to a linear change. It exhibits no abnormal break in slope: the casting takes place normally. The curve in a broken line 37 shows a change in product mass that is symptomatic of a problem of centering of the bottom block in the mold. The curve in a broken line 37 exhibits an abnormal change in mass: between time $t_0$ and time $t_d$, corresponding to the moment when the lowerator starts, the mass measured on the flow corresponding to the curve 37 is appreciably greater than the expected mass corresponding to the mass measured on the curve 36. At the time of starting of the lowerator, the measured mass decreases abruptly to a value close to an expected mass value, corresponding to the mass measured on the curve 36. This indicates that the bottom block has resumed a centered position and is no longer interacting with the walls of the mold. The mass increases once again linearly according to the same slope as the curve 36. It is desirable, when such a phenomenon is recorded, to check, during the next casting, the positioning of the bottom block. When the misalignment of the bottom block is too great, the measured mass may drop towards very low values at the time when the lowerator starts, then causing the automatic stoppage of the casting according to the principle in FIG. 8, it being understood that the time $t_c$ as from which the control of mass with respect to a threshold value Ms takes place is greater than the time $t_d$ of starting of the lowerator.

Figure 11:
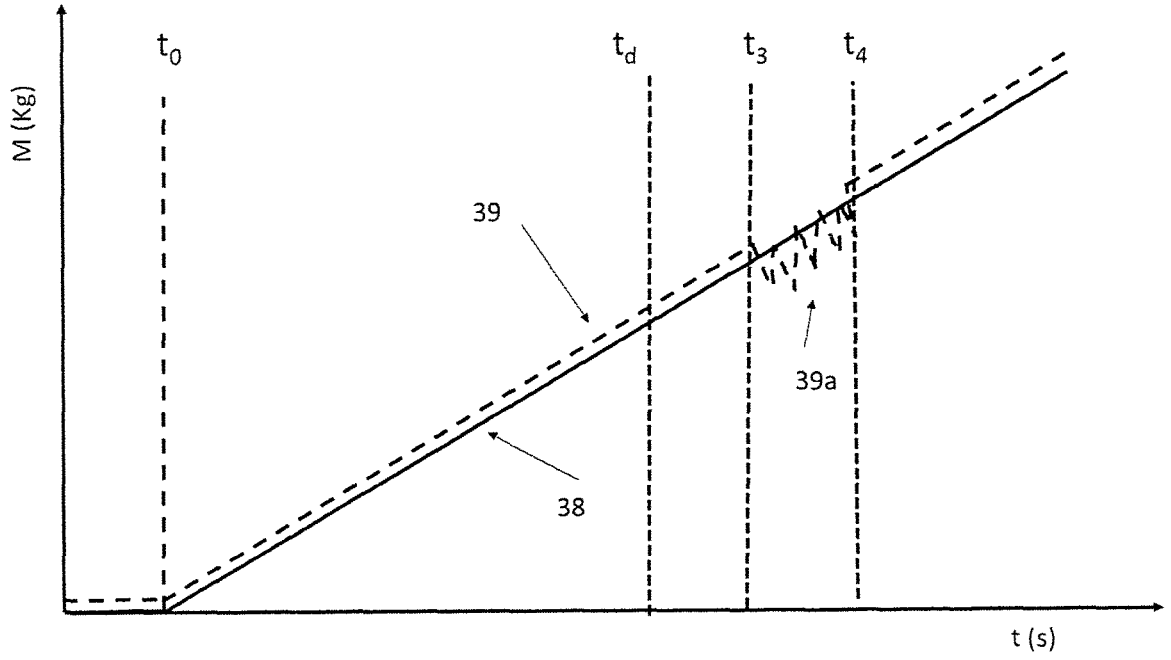
FIG. 11 illustrates schematically two product mass change curves as a function of time showing normal change and change symptomatic of faulty centering of the deflector.

FIG. 11 shows two curves for change in the mass of a product as a function of time or duration of casting. Each of the curves corresponds to a different flow occurring during the same casting. The curve in a solid line 38 corresponds to the normal change in the mass of a product. As from time $t_0$, corresponding to the start of filling, the mass increases according to a linear change. It exhibits no abnormal break in slope. The curve in a broken line 39 shows a change in product mass symptomatic of a problem of alignment of the deflector in the mold. This is because, according to the speed of casting and the geometry of the casting device, in particular the distance between the deflector and the position of the bottom block at the start of casting, the bottom block, after the lowerator starts, passes between the walls of the deflector between time $t_1$ and $t_2$. The curve 38 does not show any disturbances in the mass at the time that the bottom block passes between the deflector, while the curve 39 shows disturbances or dips 39*a* with alternating drops in masses. According to the amplitude of these disturbances, it would be desirable to automatically stop the casting or not. If the casting is not stopped, it is desirable to check, during the next casting, the positioning of the deflector. Thus the control system 100 according to the invention is capable of unambiguously detecting and differentiating five situations:

- the case of a filling defect on at least one flow
- the case of a casting with clear hanging on at least one flow
- the case of sticking or the start of hanging giving rise solely to surface defects on at least one flow
- faulty centering of the bottom block
- faulty centering of the deflector.

It goes without saying that the invention is not limited to the embodiments described above by way of examples but that it comprises all technical equivalents and variants of the means described as well as combinations thereof.

The invention claimed is:

1. A system for controlling the carrying out of the manufacture of at least one product by vertical semi-continuous casting, with direct cooling, in a fixed mold, said control system comprising:

- at least one bottom block configured to form a movable bottom base of the fixed mold and to carry the at least one product, during casting,
- at least one weighing cell, on which the at least one bottom block is disposed in abutment, the at least one weighing cell being configured to take measurements representing the mass of the at least one product carried by the at least one bottom block during casting,
- a bottom block support, to which the at least one weighing cell is connected, configured to lower the at least one bottom block with respect to the fixed mold, substantially in a vertical direction, during casting, and
- at least one processing unit connected to the at least one weighing cell, and configured to process the measurements, to calculate the variation in mass of the at least one product over the course of time.

2. The system according to claim 1, wherein the at least one weighing cell is connected to the bottom block support by means of at least one holding member provided on a plate supporting the bottom block support.

3. The system according to claim 2, wherein the at least one bottom block is held on the substantially vertical axis by means of at least one housing, the at least one housing receiving an end region of at least one member of the at least one weighing cell.

4. The system according to claim 3, wherein the at least one bottom block comprises at least one vertical holding means, configured to be engaged in a groove provided on the end region of the member of the at least one weighing cell.

5. The system according to claim 3, wherein the end region of the member of the at least one weighing cell has a height less than the depth of the at least one housing of the at least one bottom block.

6. The system according to claim 3, wherein the member of the at least one weighing cell is a sheath extending in a vertical direction and being intended to cover the holding member provided on a support plate and wherein the end region of the sheath engages in the at least one housing of the at least one bottom block.

7. The system according to claim 6, wherein the member of the at least one weighing cell, the holding member provided on the support plate supporting the bottom block support and the at least one housing of the at least one bottom block are situated in a central position of the control system.

8. The system according to claim 1, comprising a protective cover, in which the at least one weighing cell is housed.

9. The system according to claim 1, wherein the at least one product is an aluminum alloy.

10. A method for controlling the manufacture of at least one product by vertical semi-continuous casting with direct cooling by a control system according to claim 1, wherein:

- casting is carried out in the fixed mold so that the at least one product is carried by the at least one bottom block;
- during the casting, measurements are taken representing the mass of the at least one bottom block by means of the control system;
- the measurements are processed, during the casting, calculating the variation in mass of the at least one product over the course of time by means of the control system;
- the casting is stopped if an abnormality in filling or surface defects and/or hanging is detected;
- if no abnormality is detected, the casting is continued until the required quantity of the at least one product is reached and stripping from the mold is carried out.

11. The method according to claim 10, wherein the at least one product is a billet or a plate.

12. The method according to claim 10, wherein an interface makes it possible to display the variation in mass of the at least one product over time for the at least one weighing cell and/or indicates filling problems and/or surface defects and/or hanging problems and/or a problem in centering of the deflector and/or a problem in centering of the at least one bottom block according to changes in mass of the at least one product over time.

13. The method according to claim 10, wherein an automatic controller interrupts the casting when a variation in mass of the at least one product in the course of time is symptomatic of a filling problem, wherein, once a time has elapsed after the start of the casting, when the mass of the at least one product is less than or equal to a threshold mass value and/or when the variation in mass of the at least one product in the course of time is symptomatic of a hanging or surface-defect problem on the basis of predetermined conditions combining the amplitude and duration of this variation in mass.

14. The method according to claim 10, wherein the at least one product is an aluminum alloy.

* * * * *